US007176168B2

(12) United States Patent
Vann et al.

(10) Patent No.: US 7,176,168 B2
(45) Date of Patent: Feb. 13, 2007

(54) LUBRICANT CONTAINING A SYNERGISTIC COMBINATION OF RUST INHIBITORS, ANTIWEAR AGENTS, AND A PHENOTHIAZINE ANTIOXIDANT

(75) Inventors: Walter D. Vann, Marlton, NJ (US); Liehpao Oscar Farng, Lawrenceville, NJ (US); Angela S. Galiano-Roth, Mullica Hill, NJ (US); Marcia G. Rogers, Mount Holly, NJ (US); Paul Dubs, Cham (CH); Miles J. Hutchings, Scarsdale, NY (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 503 days.

(21) Appl. No.: 10/802,610

(22) Filed: Mar. 17, 2004

(65) Prior Publication Data

US 2004/0192563 A1 Sep. 30, 2004

Related U.S. Application Data

(60) Provisional application No. 60/458,640, filed on Mar. 28, 2003.

(51) Int. Cl.

| | |
|---|---|
| ***C10M 133/38*** | (2006.01) |
| ***C10M 133/12*** | (2006.01) |
| ***C10M 135/00*** | (2006.01) |
| ***C09K 3/00*** | (2006.01) |
| ***C07D 279/18*** | (2006.01) |

(52) U.S. Cl. ..... 508/253; 508/563; 508/567; 252/387; 544/35

(58) Field of Classification Search ..... 508/253
See application file for complete search history.

(56) References Cited

U.S. PATENT DOCUMENTS

| | | | | |
|---|---|---|---|---|
| 3,376,224 | A | 4/1968 | Elliott et al. | 252/47.5 |
| 3,577,343 | A * | 5/1971 | Peterli et al. | 508/243 |
| 3,803,140 | A | 4/1974 | Cook et al. | 260/243 A |
| 3,869,394 | A | 3/1975 | Daniels et al. | 252/46.7 |
| 3,882,042 | A | 5/1975 | McGuigan | 252/400 R |
| 3,912,640 | A | 10/1975 | Anzenberger | 252/47.5 |
| 4,298,481 | A | 11/1981 | Clarke | 252/21 |
| 4,798,684 | A | 1/1989 | Salomon | 252/47.5 |
| 4,877,824 | A | 10/1989 | Evans | 524/83 |
| 4,915,858 | A | 4/1990 | Salomon | 252/47.5 |
| 5,178,783 | A | 1/1993 | Salomon | 252/47.5 |
| 5,269,954 | A | 12/1993 | Germanaud | 252/47 |
| 5,275,746 | A | 1/1994 | Kapuscinski | 252/47.5 |
| 5,301,923 | A | 4/1994 | Asao et al. | 252/12.002 |
| 5,391,756 | A | 2/1995 | Karol et al. | 598/112 |
| 5,397,487 | A | 3/1995 | Pillon et al. | 252/51.5 R |
| 5,413,737 | A | 5/1995 | Evans | 252/405 |
| 5,503,759 | A * | 4/1996 | Evans et al. | 508/221 |
| 5,942,471 | A | 8/1999 | Kapuscinski | 508/251 |
| 6,407,231 | B1 * | 6/2002 | Evans et al. | 544/35 |
| 6,599,865 | B1 * | 7/2003 | Esche et al. | 508/254 |
| 2005/0090407 | A1 * | 4/2005 | Esche et al. | 508/251 |

FOREIGN PATENT DOCUMENTS

| | | |
|---|---|---|
| DE | 1594370 | 1/1970 |

* cited by examiner

*Primary Examiner*—Vasu Jagannathan
*Assistant Examiner*—Amy T. Lang
(74) *Attorney, Agent, or Firm*—Joseph J. Dvorak; Gary P. Katz

(57) ABSTRACT

The present invention describes an improved lubricant composition comprising a particularly effective combination of components comprising ashless antiwear and rust inhibitor additives with an antioxidant liquid mixture formed by reacting an olefin with a mixture of diphenylamines and phenothiozines.

8 Claims, 6 Drawing Sheets

LUBRICANT CONTAINING A SYNERGISTIC COMBINATION OF RUST INHIBITORS, ANTIWEAR AGENTS, AND A PHENOTHIAZINE ANTIOXIDANT

This application claims the benefit of U.S. Ser. No. 60/458,640 filed Mar. 28, 2003.

FIELD OF INVENTION

The present invention relates to lubricant compositions and particularly to an additive combination useful in enhancing lubricant performance such as rust inhibition, oxidation and wear control.

BACKGROUND OF INVENTION

The art is replete with descriptions of the use of myriad phenothiazine derivatives as lubricant antioxidants. Some of the many phenothiazine derivatives have alkyl substituents on the aromatic moiety of the phenothiazine; others on the nitrogen; and still others on both. Suggestions also have been made to use mixtures of diphenylamines and phenothiazines as lubricant antioxidants in the search for improved lubricant compositions.

Notwithstanding the satisfactory performance achieved by some lubricant compositions containing phenothiazine antioxidants, there remains a need for lubricant compositions that will meet ever more stringent requirements of lubricant users.

Indeed, one objective of the present invention is to enhance the rust inhibition and antiwear properties of lubricant compositions.

Another objective of the present invention is to provide a lubricant with enhanced antioxidation properties.

SUMMARY OF INVENTION

The present invention describes an improved lubricant composition comprising a particularly effective combination of components comprising ashless antiwear and rust inhibitor additives with an antioxidant liquid mixture formed by reacting $C_4$ to $C_{10}$ olefin and mixtures thereof with a mixture of diphenylamines and phenothiazines, wherein the mixture comprises at least 20 to 80 wt % of alkylated phenothiazines with 15 to 85 wt % being mono alkylated phenothiazine.

DETAILED DESCRIPTION OF INVENTION

Figure 1:
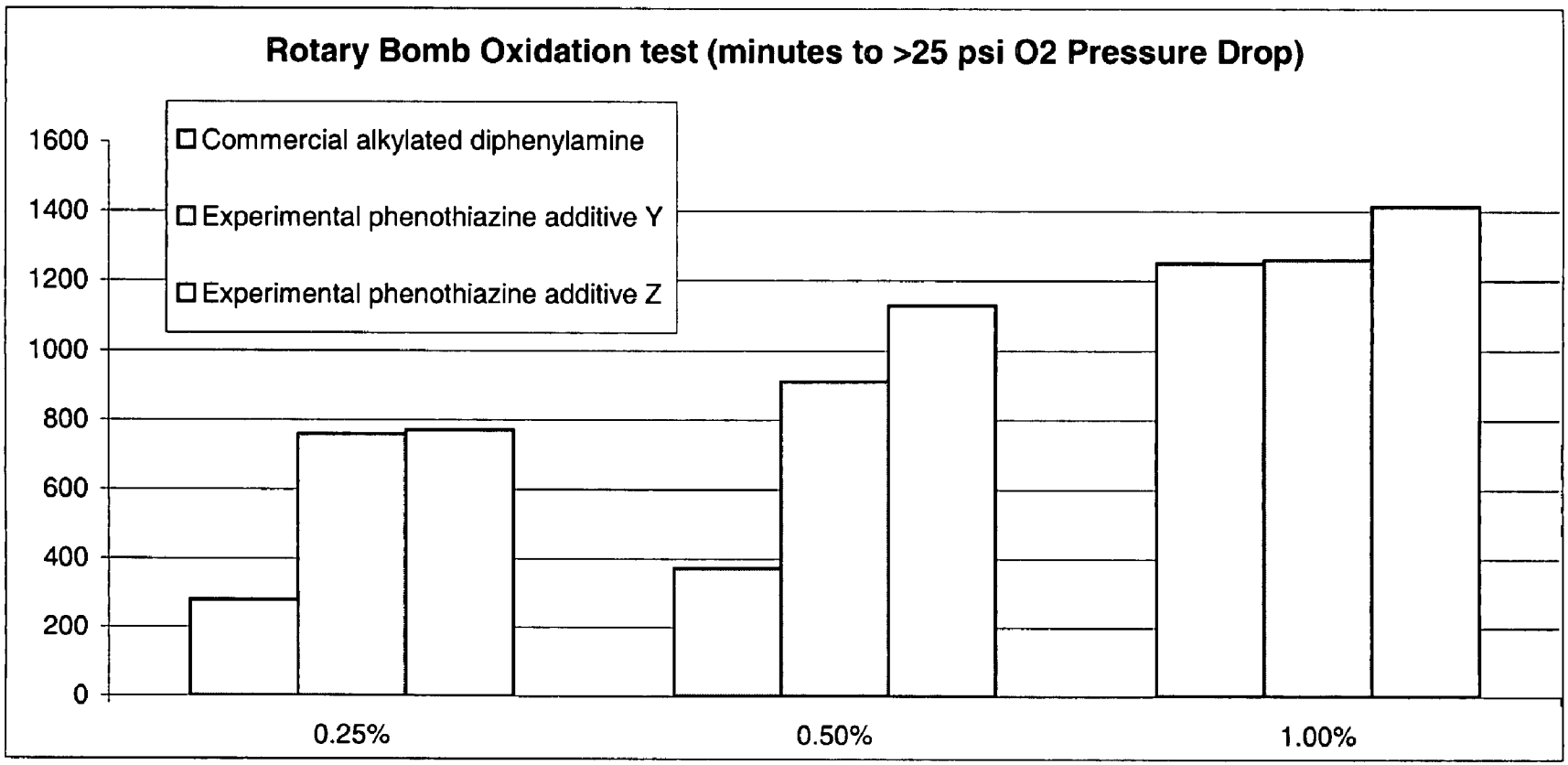
FIGS. 1 to 6 are graphs illustrating the improvement achieved in lubricants containing the additive combination of the invention.

The additive combination of the present invention is useful in formulating lubricant compositions, including greases. Indeed, the combination can be used with a variety of base stocks including Group I, II, III, IV and V base stocks, as defined by the API, and mixtures thereof. In formulating industrial oils Group II (hydroprocessed) and III (severely hydroprocessed/isomerized wax) base stocks and gas to liquid base stocks such as those derived by Fischer-Tropsch processes may be used. Indeed when using Group III base stocks gas to liquid base stocks are preferred. Similarly Group V base oils such as dibasic acid esters, polyol esters, poly alkenyl glycols, alkylated aromatics, poly internal olefins, and the like may be used alone or in combination with Group I to IV base oils. As will be appreciated alkylated aromatics include alkylated benzenes, alkylated napthalenes, alkylated diphenyl oxides, alkylated diphenyl sulfides and the like. Indeed, it is preferred to use two or more oils to provide a base oil meeting one or more preselected properties such as solvency, viscosity index, thermal stability, oxidation stability, hydrolytic stability and the like.

The amounts of nitrogen (especially basic nitrogen) and sulfur are also important to the quality of base oils. Less than 300 ppm nitrogen and 300 ppm sulfur are preferred. Less than 100 ppm nitrogen and 100 ppm sulfur are even more preferred. As an example, gas to liquid base oils have sulfur level even less than 10 ppm. Typical examples are: (a) the use of highly paraffinic oils which have less than 10 wt % aromatic components and less than 0.2 wt % nitrogen and less than 0.4 wt % sulfur, preferably less than 5 wt % aromatics with comparable amounts of nitrogen and sulfur, even more preferably, less than 1 wt % aromatics and less than 300 ppm nitrogen or sulfur to maintain high viscosity indexes and low soot formation tendencies; (b) the use of slightly branched paraffinic base oils derived from clean fuel synthetic gas processes such as Fischer-Tropsch processes with good biodegradability; and, (c) the use of synthetic alkylated aromatics with high temperature stability and good cleanliness feature.

As is typical in formulating a lubricant composition, the major ingredient in the lubricant is the base stock of lubricating viscosity. Base stocks having a viscosity index (VI) greater than 90, and even greater than 110 and still even greater than 120 may be used. Additives comprise a minor but effective amount of the lubricant and such is the case in this invention where the additive combination comprises a minor but effective amount of the lubricant composition.

An important component of the additive combination of the invention is a liquid mixture formed by reacting a $C_4$ to $C_{10}$ olefin or mixtures thereof with a mixture of diphenyl amines and phenothiazines wherein the mixture comprises at least 20 wt % and up to about to 80 wt % of alkylated phenothiazines and 15 to 85 wt % being mono alkylated phenothiazines. Specifically the liquid mixture is the reaction product obtainable from the reaction of a $C_4$ to $C_{10}$ olefin or mixtures thereof with a mixture of compounds of formula I and II

I

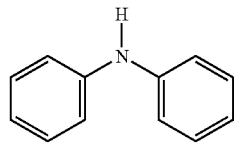

II

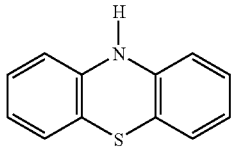

in the presence of an acid catalyst

Suitable $C_4$ to $C_{10}$ olefins include alpha olefins and internal olefins with isobutylene, diisobutylene, nonene and 1-decene being most preferred.

The general method of alkylating compounds of formula I and II with olefins is described in detail in U.S. Pat. No. 5,503,759 which is incorporated herein by reference in its entirety.

The alkylation process produces a mixture predominantly of mono and dialkylated compounds with only trace amounts of higher alkylated materials being formed.

The ratio of reactants is chosen to provide the liquid mixture with at least 20 to 80 wt %, preferably 25 to 75 wt % and more preferably 35 to 65 wt % of alkylated phenothiazines, the balance being alkylated diphenylamine, with 15 to 85 wt %, preferably 25 to 75 wt % and more preferably 33 to 67 wt % of the alkylated phenothiazines being mono alkylated phenothiazines. For example, molar ratios of olefin:pheno thiazine:diphenylamines will be in the range of about 4:3:1 to about 20:1:3.

Another component of the additive combination of the invention is an ashless antiwear additive. Among suitable ashless antiwear additives mention is made of those phosphorous containing compounds including phosphorous/sulfur, phosphorous/nitrogen and phosphorous/boron ashless antiwear additives known in the art. Examples of preferred antiwear additives are organophosphites, organophosphonates, and phosphates, thiophosphates, dithiophosphates, phosphorothionates, amine phosphates, and boron phosphates. Preferred antiwear additives include tricresyl phosphate, dioleyl phosphite, bis (2-ethyl hexyl) phosphate, diphenyl cresyl phosphate, triphenyl phosphorothionate and liquid amine phosphate.

Another component of the additive combination is an ashless rust inhibitor. Suitable rust inhibitors include those ester/amine/carboxylate/amide/sulfonate compositions known in the art. Examples of suitable esters include sorbitan monooleate, sorbitan dioleate and glycerol monooleate. Examples of suitable carboxylates include alkyl succinic acids and acid esters, alkylamino succinic acid-esters-amides and oleyl sarcosine. Examples of suitable amines, sulfonates and their-like include alkylamine sulfonates and substituted arylamine sulfonates, substituted oximes, hydrogenated tallow amine and oleyl amines. The preferred rust inhibitors are carboxylates with or without amine functionality.

A preferred lubricating composition according to the invention will also include a metal surface passivating type corrosion inhibitor such as heterocyclic compounds-exemplified by triazoles, benzotriazoles, tolytriazoles and their derivatives, and sulfur containing compounds such as 2-mercapto-benzothiazole, 2,5,-dimercapto-1,3,4-thiadiazole, 4,5,6,7-tetrahydrobenzo triazole, 5,5'methylenebis benzotriazole and the like. Especially preferred are triazole derivatives such as 2,5-dimercapto-1,3,4 thiadiazole derivatives typified by alkyl sulfide coupled 2,5 dimercapto-1,3,4 tiadiazole and vinyl ester coupled 2,5-dimercapto-1,3,4 thiadiazole.

Illustrative compositions according to the invention are given in Table 1.

TABLE 1

| Component Type | Broad Range, wt % | Preferred Range, wt % |
|---|---|---|
| Phenothiazine mixture | 0.2–2.0 | 0.4–1.5 |
| Ashless antiwear additive | 0.05–5.0 | 0.1–1.5 |
| Ashless rust inhibitor | 0.01–2.0 | 0.02–1.0 |
| Corrosion inhibitor | 0.0–0.5 | 0.01–0.2 |
| Base stock | Balance | Balance |

In a particularly preferred embodiment of the invention the phenothiazine mixture will constitute from about 0.25 wt % up to about 1 wt % of the lubricating composition.

Additional components which are typically used in industrial lubricants, hydraulic fluids, motor oils and the like which may be used in composition based on the present invention include pour point depressants, such as polymethacrylates and the like and antifoamants such as silicones. Metallic detergents, such as sulfonates, phenates and salicylates (both calcium and magnesium) and dispersants such as succinimides, succinic amide-esters can also be present for motor oils. Other antioxidants, such as molydithiocarbamates (MoDTCs), molydithiophosphates (MoDTPs), moly amides-esters, hindered phenols, can also be used to enhance the synergistic effects.

A particular advantage of the compositions of the invention is that they have excellent rust inhibition and antiwear properties making them particularly useful in industrial oil applications and especially applications where water contamination of the lubricant is a distinct possibility.

The following examples demonstrate the invention.

EXAMPLE 1

Three formulated oils were tested in a commercially available device (a rotary bomb oxidation tester, ASTM 2272) designed to predict the oxidation resistance of lubricating oils prior to the onset of oxidation as measured by a sharp oxygen pressure drop for more than 25 psi (FIG. 1). The oils were formulated with three-way combinations of either a commercial alkylated diphenylamine (Irganox L57) or a antioxidant liquid mixture according to the invention, a copper passivator and an ashless carboxylate-succinimide-imidazoline rust inhibitor in Group II base oils. The concentration of the copper passivator (Ciba Irgamet 39) is fixed at 0.05 wt % and the concentration of the carboxylate-succinimide-imidazoline rust inhibitor (Mobilad C603) is fixed at 0.1 wt %.

In the liquid antioxidant mixtures Y and Z, the alkylating agent was a $C_9$ olefin. In mixture Y 40 wt % of the alkylated phenothiazine was mono alkylated with 52 wt % of the active ingredient being alkylated phenothiazines, the balance alkylated diphenylamines. In mixture Z the amount of mono alkylated phenothiazine was 64 wt % of the total alkylated phenothiazines with 42 wt % of the active ingredients being alkylated phenothiazines, the balance alkylated diphenyl amines and diluent oils (20 wt %).

As shown in FIG. 1, these two oils formulated with phenothiazine liquid mixtures perform much better than the oil formulated with diphenylamine. The duration to resist oxidation has been extended from 13% ([1414−1250]/1250) to 203% ([1129−372]/372).

EXAMPLE 2

Figure 2:
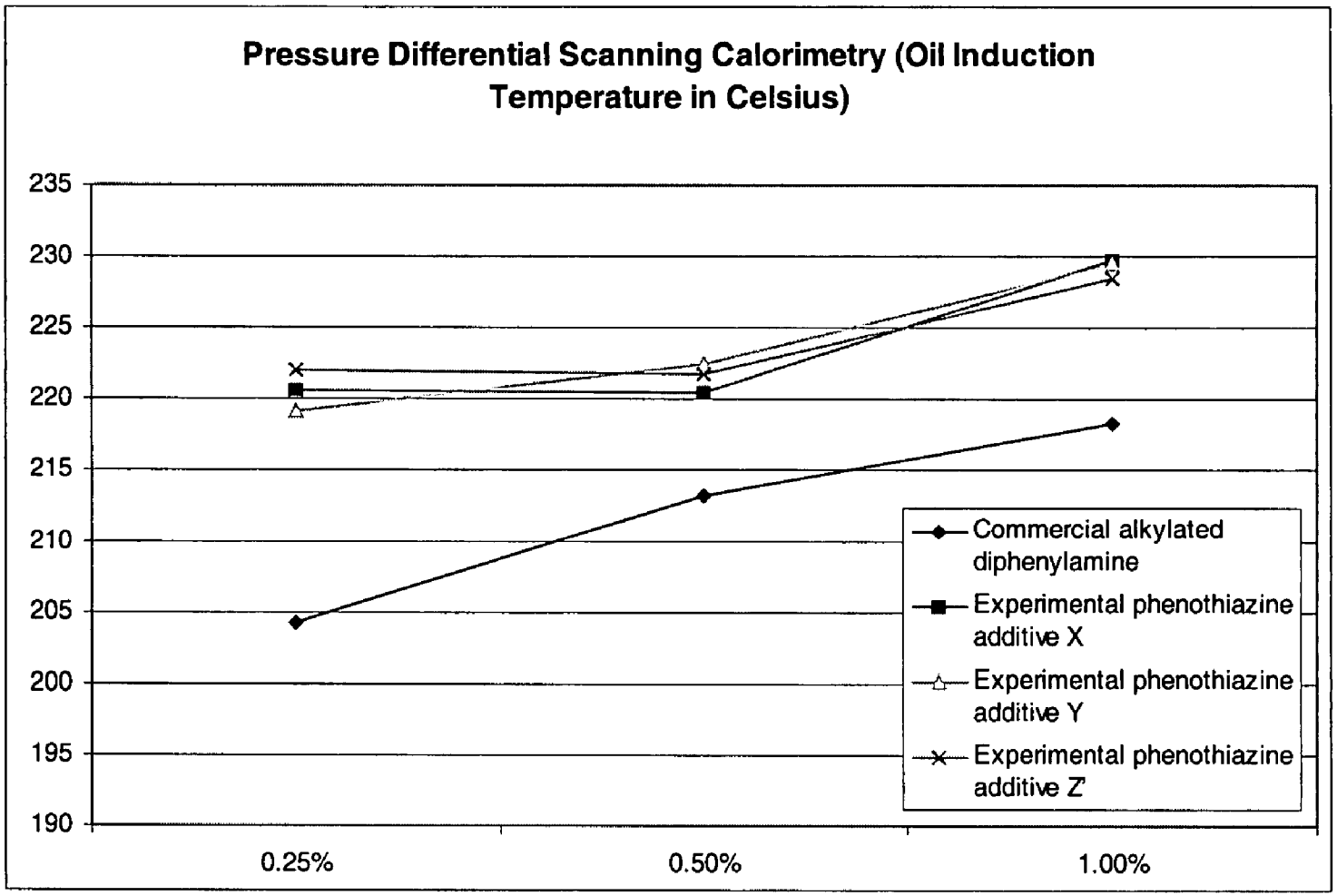

Three formulated oils were tested in a commercially available device (a pressured differential calorimetry) designed to predict the oxidation resistance of lubricating oils prior to the onset of oxidation as measured by the oil induction temperature with a temperature ramping method at 10° C./minutes (FIG. 2). The oils were formulated with three-way combinations of either a commercial, alkylated diphenylamine (Irganox L57) or a phenothiazine antioxidant liquid mixture, a copper passivator and an ashless carboxylate-succinimide-imidazoline rust inhibitor in Group II base oils. The concentration of the copper passivator (Ciba Irgamet 39) is fixed at 0.05 wt % and the concentration of the carboxylate-succinimide-imidazoline rust inhibitor (Mobilad C603) is fixed at 0.1 wt %. However, the concentrations of the antioxidants vary from 0.25 to 1.0 wt %. In antioxidant mixtures X, Y and Z' the alkylating agents were a mixture of isobutylene ($C_4$) and diisobutylene ($C_8$) for X, and nonene ($C_9$) for Y and Z'. Mixture X contained 38 wt % alkylated phenothiazines. Mixture Y was previously described in Example 1. In mixture Z' 64 wt % alkylated phenothiazines are mono-alkylated and the portion of phenothiazine alkylates being 52 wt % of the total mixture, the balance being alkylated diphenylamines. As shown in FIG. 2, the oil induction temperature has been raised by 8 to 18 degrees when the antioxidant system is changed from diphenylamine to mixtures of the invention. Since oxidation rates generally double with about every 10° C. increase in temperature, these results are impressive in terms of the ability of these oils to reduce and control oxidation (estimated to be 80% to 360% better, if translated into control of viscosity or acid number increases or other measures of control of oxidation).

EXAMPLE 3

Figure 3:
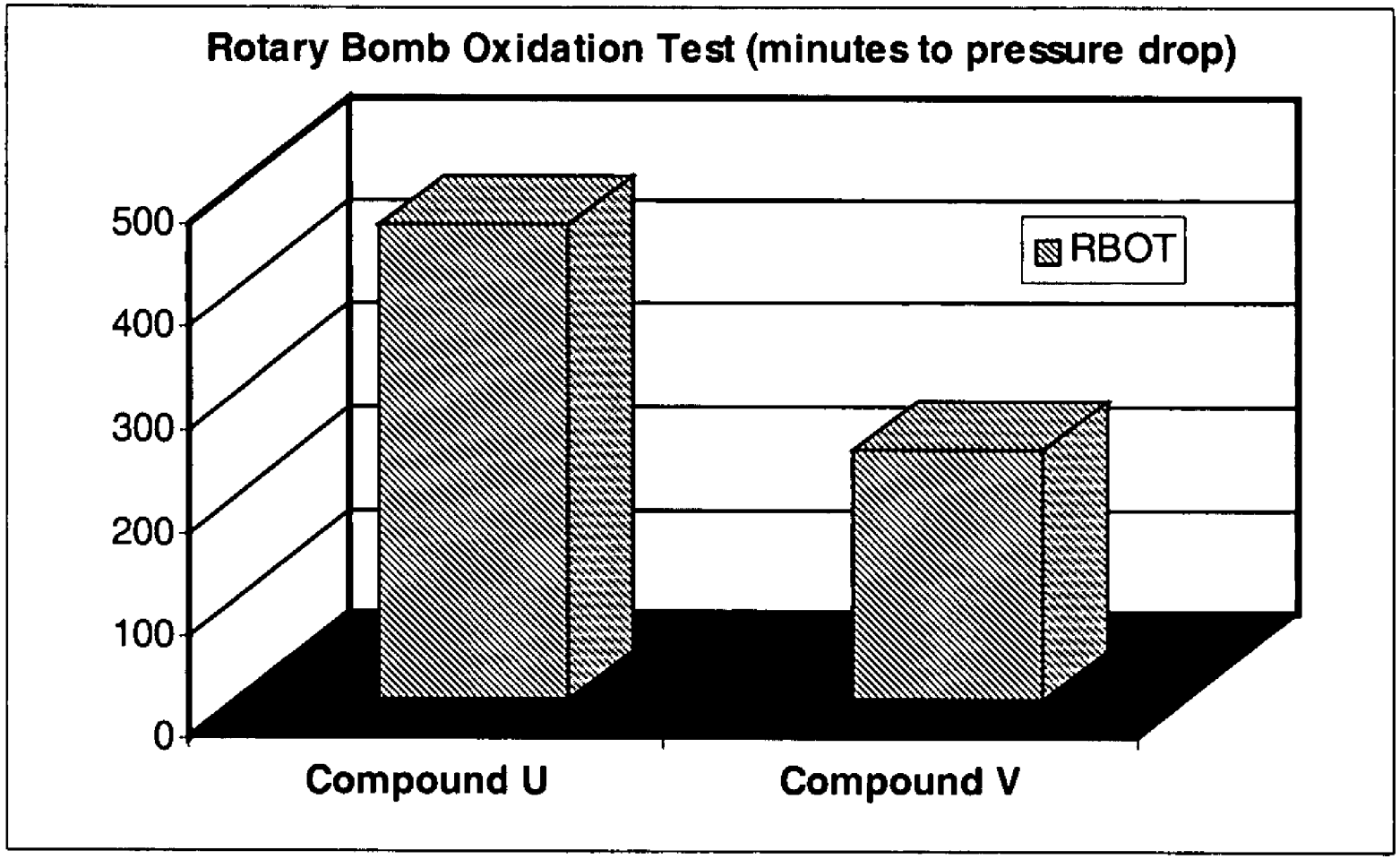

Two formulated oils were tested in a commercially available device (a rotary bomb oxidation tester, ASTM 2272) designed to predict the oxidation resistance of lubricating oils prior to the onset of oxidation as measured by a sharp oxygen pressure drop for more than 25 psi (FIG. 3). The oils were formulated with three-way combinations of either a $C_{12}$ alkylated or a $C_8$ alkylated phenothiazine, diphenylamine antioxidant, a copper passivator and an ashless carboxylate-carboxylic acid rust inhibitor in Group I base oils. Both the concentration of the copper passivator (Ciba Irgamet 39) and the concentration of the carboxylate-carboxylic acid rust inhibitor (Ciba Irgacor 12) are fixed at 0.03 wt %, while the concentrations of the phenothiazine antioxidants are fixed at 0.5 wt %. The mixtures U and V are mixtures of mono- and di-alkylated diphenylamine and mono- and di-alkylated phenothiazine with U being $C_8$ alkylated and V being $C_{12}$ alkylated.

As shown in FIG. 3, the oil formulated with the $C_8$-alkylated phenothiazine/diphenylamine mixture (mixture U) has better performance (longer oxidation resistance, 89% better) than the oil formulated with the $C_{12}$-alkylated phenothiazine/diphenylamine mixture (mixture V).

EXAMPLE 4

Three formulated oils were tested for rust inhibition by immersing polished steel panels in the test oil and thereafter exposing the panels to 100% humidity at 140° F. until 5% of the panel surface was covered with rust. The time to 5% rust formation is reported as the test result.

Each of the lubricants tested had a different antioxidant system with the amount of the phenothiazine mixture being 1 wt % in Oil A, a combination of both phenothiazine mixture (0.75 wt %) and dithiocarbamate (0.5 wt %) being 1.25 wt % total in Oil B and the amount of the dithiocarbamate antioxidant being 1 wt % in Oil C. All lubricants (Oil A, Oil B, Oil C) employed either the same or similar synthetic base stock systems. All lubricants employed a similar additive combination (i.e., ashless rush inhibitors, antiwear additives with different antioxidants). All three oils are considered high performance oils.

Figure 4:
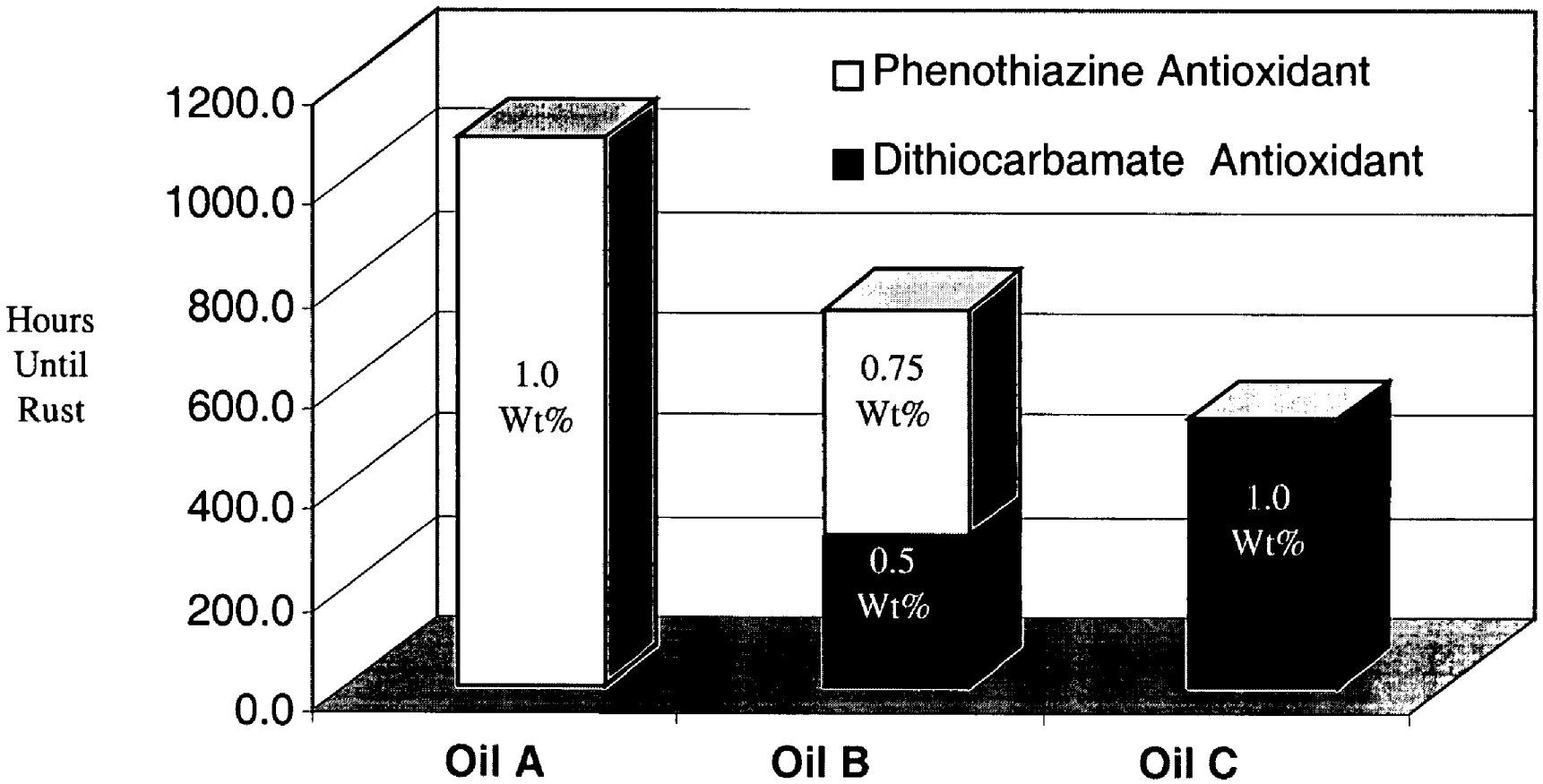

The hours until rust for Oil A was 1080, whereas it was only 744 and 528 for Oil B and Oil C respectively. The test results are shown graphically in FIG. 4. As can be seen, the rust performance of Oil A demonstrates the strongest synergy among additive combinations (i.e., rust inhibitors, antiwear additives and antioxidants). Although a combination of phenothiazine antioxidant and dithiocarbamate antioxidant in Oil B can still outperform the high performance synthetic oil formulated with dithiocarbamate antioxidant alone in Oil C, this combination is not as good as the oil formulated with phenothiazine alone in Oil A. This indicates that dithiocarbamate, a typical and effective sulfurized antioxidant, can not provide the same level of rust protection as phenothiazine. Replacing 0.25 wt % of the phenothiazine in Oil A with 0.5 wt % dithiocarbamate, as in Oil B, significantly reduces rust protection. Replacing all phenothiazine with all dithiocarbamate, as in Oil C, further reduces rust protection. The phenothiazine antioxidant used in this example is a mixture (Z") containing about 40 wt % alkylated phenothiazines, the balance being alkylated diphenylamines and some diluent oils. In mixture Z" 55 wt % alkylated phenothiazines are mono-alkylated.

EXAMPLE 5

Three formulated oils were tested in the FAG FE8 test (Test Method DIN 51819-030D07,5180-80) which is used to evaluate the effectiveness of antiwear additives. The test conditions were as follows:

| Test Conditions | |
|---|---|
| Bearings: | Cylindrical roller/thrust loaded |
| Speed: | 7.5 RPM |
| Load: | 114 KN |
| Bearing Temperature: | Variable |
| Test Duration: | 80 hours |

Figure 5:
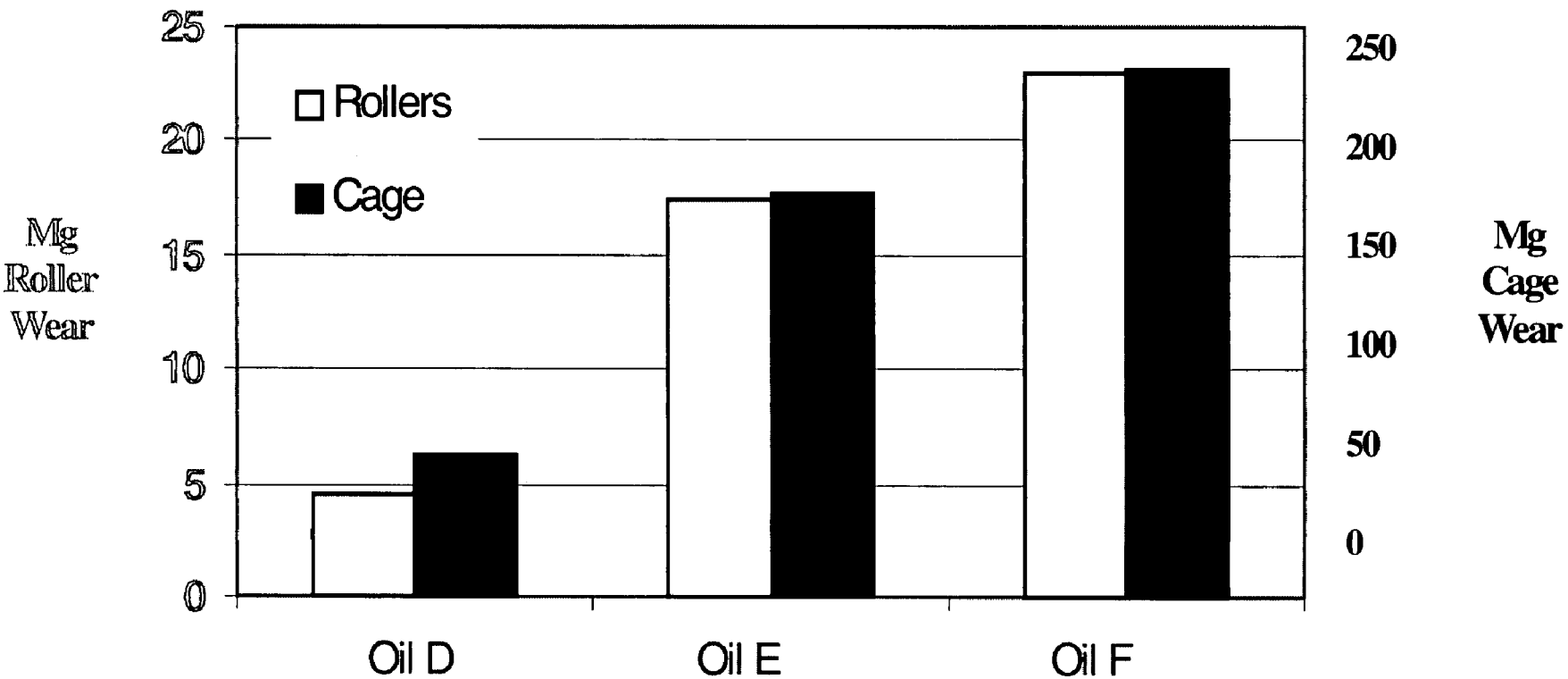

The test results are shown graphically in FIG. 5.

The first oil, Oil D, has 1.0 wt % mixed phenothiazine antioxidant, the second oil, Oil E, has 1.0 wt % dithiocarbamate antioxidant, and the third oil, Oil F, uses a mixture of phenolic and aminic antioxidants. The third oil, Oil F, is a commercial high performance oil. As can be seen, the wear performance of Oil D demonstrates the strongest synergy among the additive combinations (i.e., rust inhibitors, antiwear additives and antioxidants). Although the oil formulated with dithiocarbamate antioxidant (Oil E) can still outperform the other high performance synthetic oil formulated with phenolic and aminic antioxidants (Oil F), it is not as good as the oil formulated with phenothiazine alone (Oil D). The phenothiazine antioxidant used in this example is the mixture Z" previously described in Example 4.

EXAMPLE 6

Seven formulated oils were tested in a commercially available device (a GOST machine) designed to predict the load carrying capacity of lubricating oils prior to the onset of scuffing. Basically a test ring wetted with test oil inside a heated chamber is rotated against a loaded stationary test ball and the frictional force is sensed. The test load is increased until a coefficient of friction above 0.175 is reached to determine the scuffing load capacity. This load carrying capacity then is used to calculate a predicted FZG fail stage of the oil.

Figure 6:
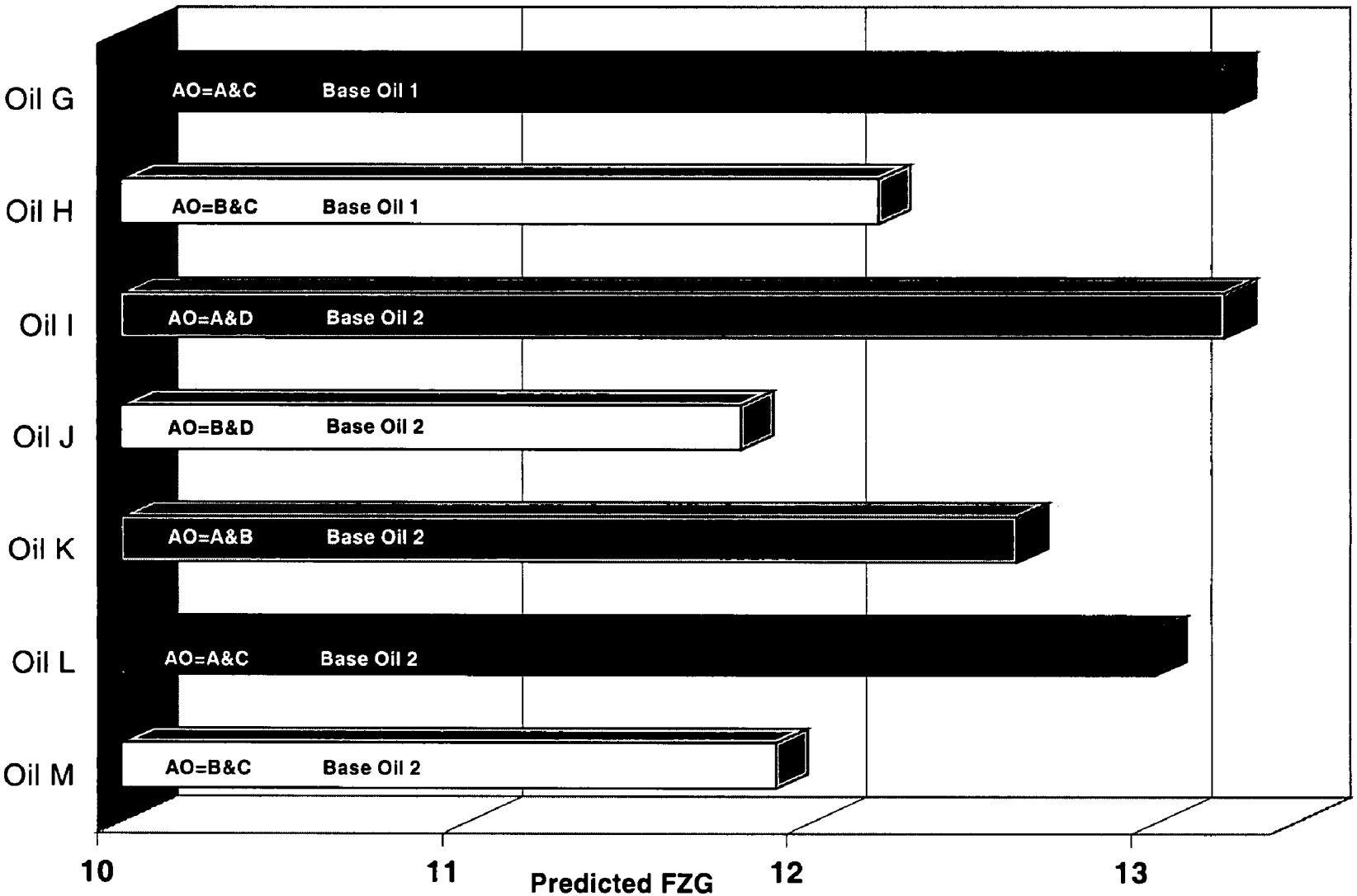

FIG. 6 gives a comparison of the predicted FZG fail stage for each of the seven oils tested in this example. Each of these oils had either a different antioxidant system or a different base stock system. The formulations containing phenothiazine (labeled as AO=A) are G, I K and L. These oils were formulated in combination with other commercially available antioxidant (AO=B, C, or D).

FIG. 6 shows several formulations using the four different antioxidants (A=phenothiazine, B=alkylated phenyl-alpha-naphthylamine, C=bis-di-tert-butylphenol, and D=hindered esterified phenolic) and two different base stock combinations (base oil 1 or 2). These comparisons demonstrate the antiwear synergy achieved when using the optimal antiwear additives and rust inhibitors in combination with the phenothiazine. The phenothiazine antioxidant used in this example was the mixture X previously described in Example 2.

What is claimed is:

1. A lubricant composition comprising:

a major amount of a base stock of lubricating viscosity; and a minor amount of an additive combination including (i) a mixture of mono and dialkylated diphenylamine and mono and dialkylated phenothiazines having alkyl groups of 4 to 10 carbon atoms wherein the alkylated phenothiazines comprise at least 20 to 80 wt % of the mixture with 15 to 85 wt % of the alkylated phenothiazines being mono alkylated;

(ii) an ashless anti wear additive; and (iii) an ashless rust inhibitor.

2. The composition of claim 1 wherein the ashless antiwar additives are phosphorous containing compounds.

3. The composition of claim 2 wherein the rust inhibitors are organoesters, amides, amines, sulfonates and carboxylates.

4. The composition of claim 3 including a metal corrosion inhibitor.

5. The composition of claim 4 wherein the composition comprises 0.2–2 wt % of the liquid mixture, 0.05–5 wt % of the antiwear additive and 0.01 to 2 wt % of the rust inhibitor.

6. The composition of claim 5 including 0.0 to 0.5 wt % of a metal corrosion inhibitor.

7. The composition of claim 6 wherein the basestock is a mixture of two or more oils of lubricating viscosity.

8. The composition of claim 7 wherein one of the oils is selected from the group consisting of paraffinic oils having less than 10 wt % aromatics, slightly branched paraffinic base oils derived from gas to liquid processes, and synthetic alkylated aromatic oils.

* * * * *